US011538403B2

(12) United States Patent
Liu et al.

(10) Patent No.: US 11,538,403 B2
(45) Date of Patent: Dec. 27, 2022

(54) PIXEL DRIVING CIRCUIT, DRIVING CONTROL METHOD, AND DISPLAY PANEL

(71) Applicant: BOE Technology Group Co., Ltd., Beijing (CN)

(72) Inventors: Dongni Liu, Beijing (CN); Minghua Xuan, Beijing (CN); Qi Qi, Beijing (CN); Jing Liu, Beijing (CN)

(73) Assignee: BOE Technology Group Co., Ltd., Bejjing (CN)

( * ) Notice: Subject to any disclaimer, the term of this patent is extended or adjusted under 35 U.S.C. 154(b) by 0 days.

(21) Appl. No.: 17/476,360

(22) Filed: Sep. 15, 2021

(65) Prior Publication Data

US 2022/0238065 A1 Jul. 28, 2022

(30) Foreign Application Priority Data

Jan. 26, 2021 (CN) ..... 202110104243.X

(51) Int. Cl.
*G09G 3/32* (2016.01)

(52) U.S. Cl.
CPC ..... *G09G 3/32* (2013.01); *G09G 2300/0426* (2013.01); *G09G 2300/0809* (2013.01); (Continued)

(58) Field of Classification Search
CPC ..... G09G 3/2003; G09G 3/2007; G09G 3/32–3291; G09G 2300/0426; G09G 2300/0809; G09G 2300/0819; G09G 2300/0833; G09G 2300/0838; G09G 2300/0842; G09G 2300/0861; G09G 2300/0871; G09G 2310/0213; G09G 2310/0243; G09G 2310/0262; (Continued)

(56) References Cited

U.S. PATENT DOCUMENTS

2014/0362130 A1* 12/2014 Duan ..... G09G 3/3241 345/77
2015/0061537 A1* 3/2015 Kanda ..... G09G 3/3233 315/291

(Continued)

FOREIGN PATENT DOCUMENTS

JP 2008191684 A * 8/2008

OTHER PUBLICATIONS

English translation of JP-2008191684-A (Year: 2008).*

*Primary Examiner* — Nathan Danielsen
(74) *Attorney, Agent, or Firm* — IPro, PLLC

(57) ABSTRACT

The present disclosure provides a pixel driving circuit and a display panel. The pixel driving circuit includes a driving module and a grayscale adjustment module. The driving module is configured to generate a first driving current corresponding to a first grayscale range under the control of a potential at a gate voltage end and a first power source voltage, and transmit the first driving current to a light-emitting element. The grayscale adjustment module is configured to adjust the driving module under the control of the first power source voltage and a first data voltage, so that the driving module generates a second driving current corresponding to a second grayscale range under the control of the potential at the gate voltage end and the first power source voltage, and transmits the second driving current to the light-emitting element.

19 Claims, 6 Drawing Sheets

(52) U.S. Cl.
CPC ..... *G09G 2300/0842* (2013.01); *G09G 2300/0852* (2013.01); *G09G 2310/0262* (2013.01); *G09G 2310/061* (2013.01); *G09G 2310/08* (2013.01); *G09G 2320/0242* (2013.01)

(58) Field of Classification Search
CPC ..... G09G 2310/027; G09G 2310/0272; G09G 2310/0289; G09G 2310/061; G09G 2310/08; G09G 2320/0233; G09G 2320/0242; G09G 2320/0271; G09G 2320/0276; G09G 2320/066–0673
See application file for complete search history.

(56) References Cited

U.S. PATENT DOCUMENTS

| | | | | |
|---|---|---|---|---|
| 2018/0025690 | A1* | 1/2018 | Bao | G09G 3/3225 345/691 |
| 2018/0247595 | A1* | 8/2018 | Feng | G09G 3/3258 |
| 2020/0302860 | A1* | 9/2020 | Kim | G09G 3/3291 |

* cited by examiner

PIXEL DRIVING CIRCUIT, DRIVING CONTROL METHOD, AND DISPLAY PANEL

CROSS-REFERENCE TO RELATED APPLICATION

This application claims a priority of the Chinese Patent Application No. 202110104243.X filed on Jan. 26, 2021, which is incorporated herein by reference in its entirety.

TECHNICAL FIELD

The present disclosure relates to the field of display technology, in particular to a pixel driving circuit, a driving control method and a display panel.

BACKGROUND

Micro Light-Emitting Diode (Micro-LED) display technology, sub-millimeter light-emitting diode (Mini-LED) display technology and Organic Light-Emitting Diode (OLED) display technology have been considered as the most competitive next-generation display technologies due to such characteristics as low driving voltage, ultra-high brightness, long service life and high temperature resistance.

In the related art, it is able for such a light-emitting element as a Micro-LED, a Mini-LED and an OLED to achieve a display function through a current from a pixel driving circuit, achieve the display function at different grayscales in accordance with different data voltages, and further achieve the display of a real image through gamma adjustment. On one hand, during the gamma adjustment at middle and low grayscales, since a low-grayscale gamma slope is much smaller than a high-grayscale gamma slope, a smaller data step (a minimum data voltage-division capability) is required to acquire brightness values at low grayscales. On the other hand, luminous efficiency of the light-emitting element, a brightness value of light emitted by the light-emitting element, and chromaticity coordinates vary along with a current density. A driving current at a high current density is required to ensure the luminous efficiency of the light-emitting element and the stable light. The driving current is positively correlated with the data voltage, a minimum data step of an Integrated Circuit (IC) is limited, so it is impossible for the light-emitting element to fully realize the display function at low grayscales.

SUMMARY

An object of the present disclosure is to provide a pixel driving circuit, a driving control method and a display panel, so as to solve the above-mentioned problem.

In one aspect, the present disclosure provides in some embodiments a pixel driving circuit for driving a light-emitting element, including a driving module and a grayscale adjustment module. The driving module is coupled to a gate voltage end, a first power source end, the light-emitting element and the grayscale adjustment module, and configured to generate a first driving current corresponding to a first grayscale range under the control of a potential at the gate voltage end and a first power source voltage at the first power source end, and transmit the first driving current to the light-emitting element. The grayscale adjustment module is further coupled to the first power source end, a control end of the grayscale adjustment module is coupled to a first data end, and the grayscale adjustment module is configured to adjust the driving module under the control of the first power source voltage and a first data voltage at the first data end, so that the driving module generates a second driving current corresponding to a second grayscale range under the control of the potential at the gate voltage end and the first power source voltage, and transmits the second driving current to the light-emitting element.

In a possible embodiment of the present disclosure, the pixel driving circuit further includes a first data write-in module electrically coupled to a second data end, a first gate control end, the driving module and the grayscale adjustment module, and configured to write a second data voltage at the second data end into the driving module and the grayscale adjustment module under the control of a first gate control signal from the first gate control end.

In a possible embodiment of the present disclosure, the pixel driving circuit further includes a first light-emission control module and a second light-emission control module. The driving module is electrically coupled to the first power source end through the first light-emission control module, and the grayscale adjustment module is electrically coupled to the first power source end through the first light-emission control module. The first light-emission control module is electrically coupled to a light-emission control end, and configured to control the driving module to be electrically coupled to the first power source end and control the grayscale adjustment module to be electrically coupled to the first power source end under the control of a light-emission control signal from the light-emission control end. The driving module is electrically coupled to the light-emitting element through the second light-emission control module, and the second light-emission control module is electrically coupled to the light-emission control end, and configured to control the driving module to be electrically coupled to the light-emitting element under the control of the light-emission control signal.

In a possible embodiment of the present disclosure, the pixel driving circuit further includes a second data write-in module. The control end of the grayscale adjustment module is electrically coupled to the first data end through the second data write-in module, and the second data write-in module is further electrically coupled to a second gate control end, and configured to write the first data voltage into the control end of the grayscale adjustment module under the control of a second gate control signal from the second gate control end.

In a possible embodiment of the present disclosure, the first light-emission control module includes a first light-emission control transistor, and the second light-emission control module includes a second light-emission control transistor. A control electrode of the first light-emission control transistor is electrically coupled to the light-emission control end, a first electrode of the first light-emission control transistor is electrically coupled to the first voltage end, and a second electrode of the first light-emission control transistor is electrically coupled to the driving module and the grayscale adjustment module. A control electrode of the second light-emission control transistor is electrically coupled to the light-emission control end, a first electrode of the second light-emission control transistor is electrically coupled to the driving module, and a second electrode of the second light-emission control transistor is electrically coupled to the light-emitting element.

In a possible embodiment of the present disclosure, the driving module includes a first driving transistor and a second driving transistor. A first electrode of the first driving transistor is electrically coupled to the first power source end through the first light-emission control module, a second electrode of the first driving transistor is electrically coupled to the light-emitting element through the second light-emission control module, a control electrode of the first driving transistor is electrically coupled to the gate voltage end, and the first driving transistor is configured to generate the first driving current. A first electrode of the second driving transistor is electrically coupled to the grayscale adjustment module, a second electrode of the second driving transistor is electrically coupled to the second electrode of the first driving transistor, a control electrode of the second driving transistor is electrically coupled to the gate voltage end, and the first driving transistor and the second driving transistor are configured to jointly generate the second driving current.

In a possible embodiment of the present disclosure, a width-to-length ratio of a channel of the first driving transistor is smaller than a width-to-length ratio of a channel of the second driving transistor.

In a possible embodiment of the present disclosure, the grayscale adjustment module includes a first transistor, a first electrode of which is electrically coupled to the first power source end through the first light-emission control module, a second electrode of which is electrically coupled to the driving module, and a control electrode of which is electrically coupled to the first data end through the second data write-in module.

In a possible embodiment of the present disclosure, the second data write-in module includes a second transistor, a first electrode of which is electrically coupled to the first data end, a control electrode of which is electrically coupled to the second gate control end, and a second electrode of which is electrically coupled to the control end of the grayscale adjustment module.

In a possible embodiment of the present disclosure, the first data write-in module includes a data write-in transistor, a first electrode of which is electrically coupled to the second data end, and a control electrode of which is connected to the first gate electrode, and a second end of which is electrically coupled to the driving module and the grayscale adjustment module.

In a possible embodiment of the present disclosure, the pixel driving circuit further includes a compensation module electrically coupled to a first gate control end, the gate voltage end, the second electrode of the first driving transistor and the second electrode of the second driving transistor, and configured to control the second electrode of the first driving transistor to be electrically coupled to the gate voltage end and control the second electrode of the second driving transistor to be electrically coupled to the gate voltage end under the control of a first gate control signal from the first gate control end.

In a possible embodiment of the present disclosure, the compensation module includes a compensation transistor, a first electrode of which is electrically coupled to the second electrode of the first driving transistor and the second electrode of the second driving transistor, a second electrode of which is electrically coupled to the gate voltage end, and a control electrode of which is electrically coupled to the first gate control end.

In a possible embodiment of the present disclosure, the pixel driving circuit further includes a first energy storage module and a second energy storage module. The first energy storage module is electrically coupled to the gate voltage end, and configured to store electric energy and maintain the potential at the gate voltage end. The second energy storage module is electrically coupled to the control end of the grayscale adjustment module, and configured to store electric energy and maintain the potential at the control end of the grayscale adjustment module.

In a possible embodiment of the present disclosure, the first energy storage module includes a first storage capacitor, and the second energy storage module includes a second storage capacitor. A first electrode plate of the first storage capacitor is electrically coupled to the gate voltage end, and a second electrode plate of the first storage capacitor is electrically coupled to the first power source end. A first electrode plate of the second storage capacitor is electrically coupled to the control end of the grayscale adjustment module, and a second electrode plate of the second storage capacitor is electrically coupled to the first power source end.

In a possible embodiment of the present disclosure, the pixel driving circuit further includes a resetting module electrically coupled to a resetting signal end, a resetting control end, the gate voltage end and a first electrode of the light-emitting element, and configured to write a resetting signal from the resetting signal end into the gate voltage end and the first electrode of the light-emitting element under control of a resetting control signal from the resetting control end. A second electrode of the light-emitting element is electrically coupled to a second power source end.

In a possible embodiment of the present disclosure, the resetting module includes a first resetting transistor and a second resetting transistor. A first electrode of the first resetting transistor is electrically coupled to the resetting signal end, a second electrode of the first resetting transistor is electrically coupled to the gate voltage end, and a control electrode of the first resetting transistor is electrically coupled to the resetting control end. A first electrode of the second resetting transistor is electrically coupled to the resetting signal end, a second electrode of the second resetting transistor is electrically coupled to the first electrode of the light-emitting element, and a control electrode of the second resetting transistor is electrically coupled to the resetting control end.

In another aspect, the present disclosure provides in some embodiments a driving control method for the above-mentioned pixel driving circuit. A display period includes a data write-in stage and a light-emission stage. The method includes: at the data write-in stage, applying a first data voltage at the first data end to the control end of the grayscale adjustment module, and applying a second data voltage to the gate voltage end; and at the light-emission stage, generating, by the grayscale adjustment module, an adjustment signal under the control of a potential at the control end of the grayscale adjustment module, and generating, by the driving module, a second driving current under the control of a first power source voltage at the first power source end, a potential at the gate voltage end and the adjustment signal from the grayscale adjustment module; or, the method includes: at the data write-in stage, applying a second data voltage to the gate voltage end; and at the light-emission stage, generating, by the driving module, a first driving current under the control of the first power source voltage at the first power source end and the potential at the gate voltage end.

In yet another aspect, the present disclosure provides in some embodiments a display panel including the light-emitting element and the above-mentioned pixel driving circuit. The pixel driving circuit is configured to drive the light-emitting element to emit light.

In a possible embodiment of the present disclosure, the pixel driving circuit further includes a first light-emission control module and a second light-emission control module.

The driving module is electrically coupled to the first power source end through the first light-emission control module, and the grayscale adjustment module is electrically coupled to the first power source end through the first light-emission control module. The first light-emission control module is electrically coupled to a light-emission control end, and configured to control the driving module to be electrically coupled to the first power source end and control the grayscale adjustment module to be electrically coupled to the first power source end under the control of a light-emission control signal from the light-emission control end. The driving module is electrically coupled to the light-emitting element through the second light-emission control module, the second light-emission control module is electrically coupled to the light-emission control end, and configured to control the driving module to be electrically coupled to the light-emitting element under the control of the light-emission control signal.

In a possible embodiment of the present disclosure, the pixel driving circuit further includes a second data write-in module, the control end of the grayscale adjustment module is electrically coupled to the first data end through the second data write-in module, the second data write-in module is further electrically coupled to a second gate control end, and configured to write the first data voltage into the control end of the grayscale adjustment module under the control of a second gate control signal from the second gate control end.

The additional aspects and advantages of the present disclosure will be given or may become apparent in the following description, or may be understood through the implementation of the present disclosure.

BRIEF DESCRIPTION OF THE DRAWINGS

The above and/or additional aspects as well as advantages of the present disclosure will become apparent and are easily understood in the following description with reference with the following drawings. In these drawings.

Figure 1:
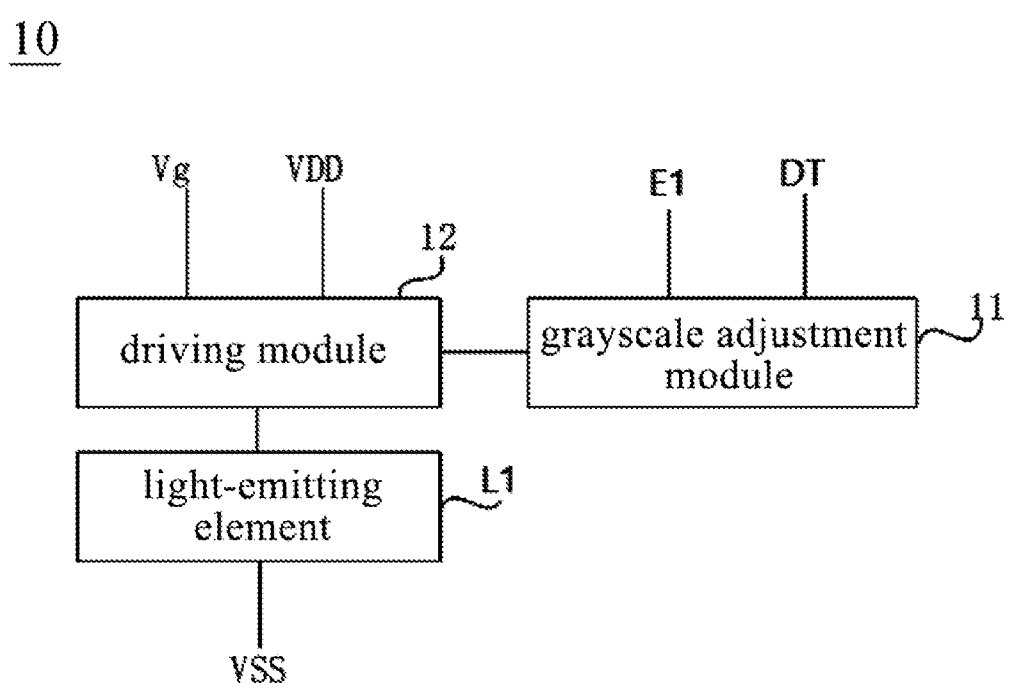
FIG. 1 is a schematic view showing a pixel diving circuit according to one embodiment of the present disclosure.

REFERENCE SIGN LIST pixel driving circuit 10
driving module 11
first driving transistor T3
second driving transistor T8
grayscale adjustment module 12
first transistor T9
first data write-in module 13
data write-in transistor T2
compensation module 14
compensation transistor T5
first energy storage module 151
second energy storage module 152
first storage capacitor C1
second storage capacitor C2
resetting module 16
first resetting transistor T1
second resetting transistor T7
first light-emission control module 171
second light-emission control module 172
first light-emission control transistor T4
second light-emission control transistor T6
second data write-in module 18
second transistor T10
first power source end VDD
second power source end VSS
first data end DT
second data end DI
first gate control end GA
second gate control end GB
resetting signal end F1
resetting control end R1
light-emission control end E1
gate voltage end Vg
light-emitting element L1
light-emitting diode O1
display panel 100

DETAILED DESCRIPTION

The embodiments of the present disclosure will be described hereinafter in conjunction with the embodiments and the drawings. Identical or similar reference numbers in the drawings represent an identical or similar element or elements having an identical or similar function. The following embodiments are for illustrative purposes only, but shall not be used to limit the scope of the present disclosure.

In the embodiments of the present disclosure, it should be appreciated that, such words as "in the middle of", "longitudinal", "lateral", "length", "width", "thickness", "on/above", "under/below", "front", "back", "left", "right", "vertical", "horizontal", "top", "bottom", "inside", "outside", "clockwise" and "counterclockwise" may be used to indicate directions or positions as viewed in the drawings, and they are merely used to facilitate the description in the present disclosure, rather than to indicate or imply that a device or member must be arranged or operated at a specific position. In addition, such words as "first", and "second" may be merely used to differentiate different components rather than to indicate or imply any importance or explicitly indicate the number of the defined technical features. In this regard, the technical features defined with such words as "first" and "second" may implicitly or explicitly include one or more technical features. Further, such an expression as "a plurality of" is used to indicate that there are at least two, e.g., two or three, components, unless otherwise specified.

Unless otherwise specified and defined, such words as "install", "connect" and "fix" may have a general meaning, e.g., fixed connection, detachable connection or integral connection, a mechanical connection or an electrical connection, or direct connection or indirect connection via an intermediate component, communication between two components or an internal communication between two elements or an interaction between two elements. The meanings of these words may be understood by a person skilled in the art according to the practical need.

In the present disclosure, unless otherwise specified and defined, when a first feature is "on" or "under" a second feature, it means that the first feature is in direct contact with the second feature, or the first feature is in in indirect contact with the second feature through another feature between them. Moreover, when the first feature is "above", "over", and "on" the second feature, it means that the first feature is directly above or obliquely above the second feature, or simply indicates that a horizontal height of the first feature is higher than a horizontal height of the second feature. When the first feature is "below", "under" and "underside" the second feature, it indicates that the first feature is directly or obliquely below the second feature, or simply indicates that a horizontal height of the first feature is lower than a horizontal height of the second feature.

Many different embodiments or examples are provided hereinafter to achieve different structures in the present disclosure. For ease of description, the components and arrangements in specific examples will be described below. Of course, they are merely illustrative rather than restrictive. In addition, reference numerals and/or reference letters are repeated in different examples in the present disclosure, which is for the purpose of simplification and clarity and does not indicate the relationship between the various embodiments and/or arrangements. In addition, the present disclosure provides examples of various specific processes and materials, but a person skilled in the art may realize the application of other processes and/or the use of other materials.

Figure 7:
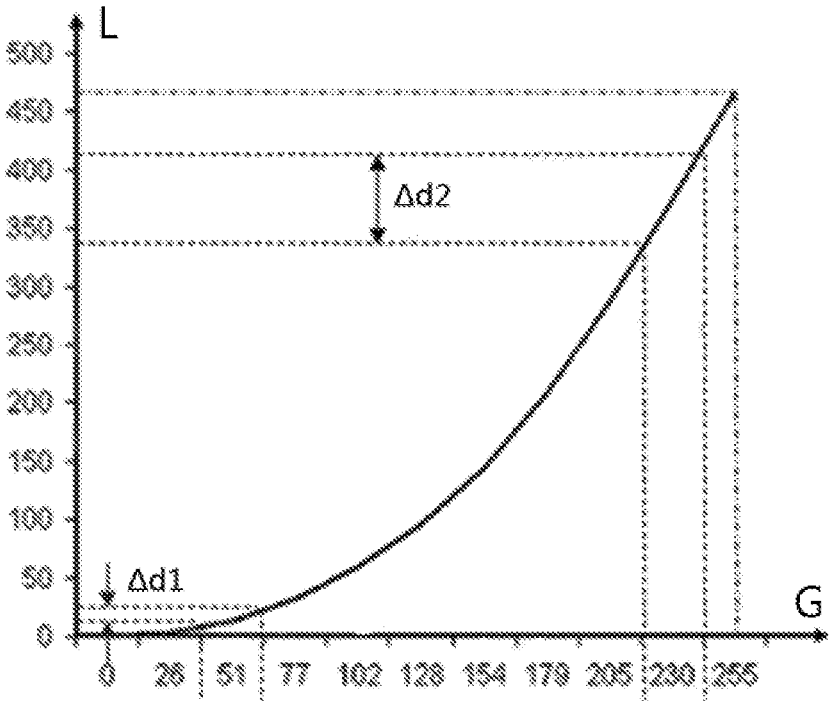
PRIOR ART Fig. 7
FIG. 7 is a schematic diagram of a relationship between a grayscale and a brightness value.

As shown in FIG. 7, a non-linear function relationship between a brightness value L and a grayscale G of an electroluminescent element is represented as a gamma curve (in FIG. 7, a horizontal axis represents the brightness value L in unit of nit, and a vertical axis represents the grayscale G). When a light-emitting element is driven by one thin-film transistor to operate, the thin-film transistor applies a driving current related to a gate voltage and a source voltage thereof to the light-emitting element, and there is a linear relationship between the driving current and the brightness value. Hence, through deduction, for example, as shown in FIG. 7, a brightness difference Δd1 corresponding to m grayscales (m is a positive integer) at low grayscales is much smaller than a brightness difference Δd2 corresponding to m grayscales at high grayscales, and a difference between amplitudes of data voltages corresponding to m grayscales at low grayscales is much smaller than a difference between amplitudes of data voltages corresponding to m grayscales at high grayscales. However, the data voltage is generated by an external digital signal source (such as an IC), and a minimum difference between amplitudes of different data voltages generated by the IC is limited, so it is difficult to meet the difference between the amplitudes of data voltages corresponding to m grayscales at low grayscales, thereby it is difficult for the electroluminescent element to accurately achieve low-grayscale brightness values.

The electroluminescent element includes any of an OLED, a Mini LED, a Micro LED or a Quantum Light-Emitting Diode (QLED).

Referring to FIG. 1, the present disclosure provides in some embodiments a pixel driving circuit 10 for driving a light-emitting element L1, which includes a driving module 11 and a grayscale adjustment module 12, so as to at least solve the problem that it is difficult for an electroluminescent element in the related art to accurately achieve low-grayscale brightness values.

The driving module 11 is coupled to a gate voltage end Vg, a first power source end VDD, the light-emitting element L1 and the grayscale adjustment module 12, and configured to generate a first driving current corresponding to a first grayscale range under the control of a potential at the gate voltage end Vg and a first power source voltage at the first power source end VDD, and transmit the first driving current to the light-emitting element L1.

The grayscale adjustment module 12 is further coupled to the first power source end VDD, a control end of the grayscale adjustment module 12 is coupled to a first data end DT, and the grayscale adjustment module 12 is configured to adjust the driving module 11 under the control of the first power source voltage and a first data voltage at the first data end DT, so that the driving module 11 generates a second driving current corresponding to a second grayscale range under the control of the potential at the gate voltage end Vg and the first power source voltage, and transmits the second driving current to the light-emitting element L1.

According to the pixel driving circuit in the embodiments of the present disclosure, through setting the driving module 11 and the grayscale adjustment module 12 in such a manner that the driving module 11 generates the first driving current under the control of the potential at the gate voltage end Vg and the first power source voltage, and transmits the first driving current to the light-emitting element L1, it is able for the light-emitting element L1 to achieve a display function in the first grayscale range. In addition, the driving module 11 generates the second driving current under the control of the grayscale adjustment module 12 as well as under the control of the potential at the gate voltage end Vg and the first power source voltage, and transmits the second driving current to the light-emitting element L1. In this way, it is able for the light-emitting element L1 to realize a multi-grayscale display function, thereby to improve a display effect of the light-emitting element L1.

Figure 2:
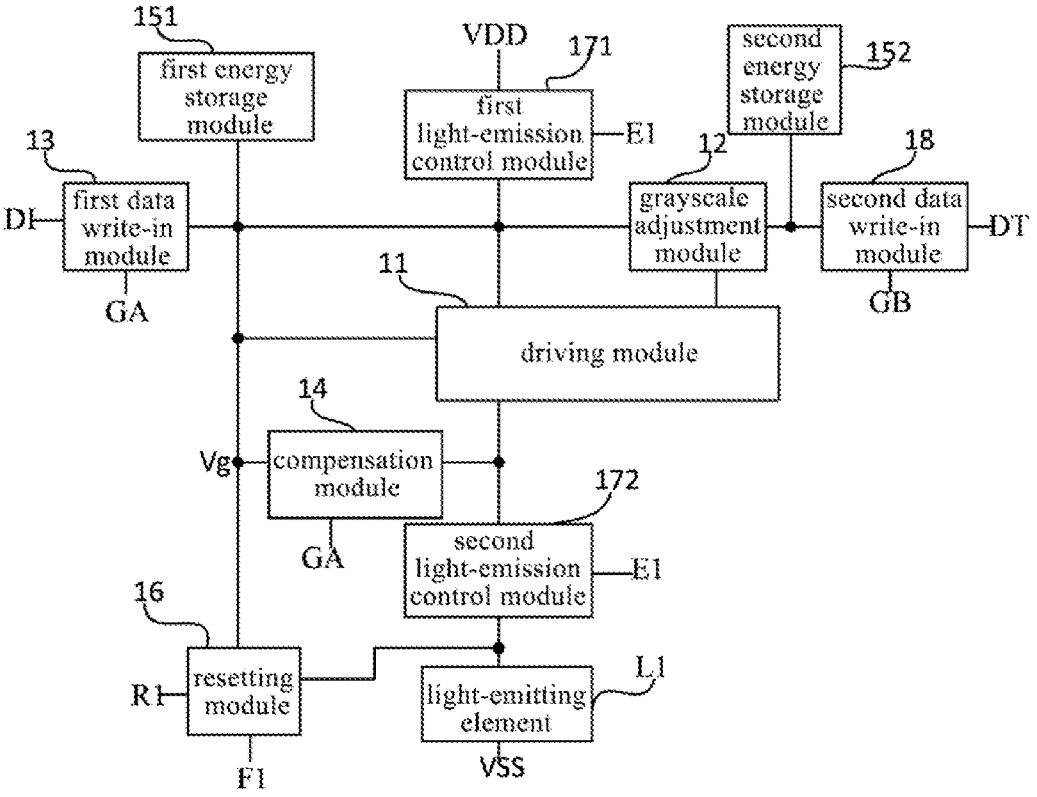
FIG. 2 is another schematic view showing the pixel driving circuit according to one embodiment of the present disclosure.

In at least one embodiment of the present disclosure, the light-emitting element L1 is any kind of an OLED, a Mini LED, a Micro LED or a QLED. As shown in FIGS. 1 and 2, a first electrode of the light-emitting element L1 is electrically coupled to the driving module 11, and a second electrode of the light emitting element L1 is electrically coupled to a second power source end VSS.

In at least one embodiment of the present disclosure, the first electrode of the light-emitting element is an anode, and the second electrode of the light-emitting element is a cathode.

Figure 4:
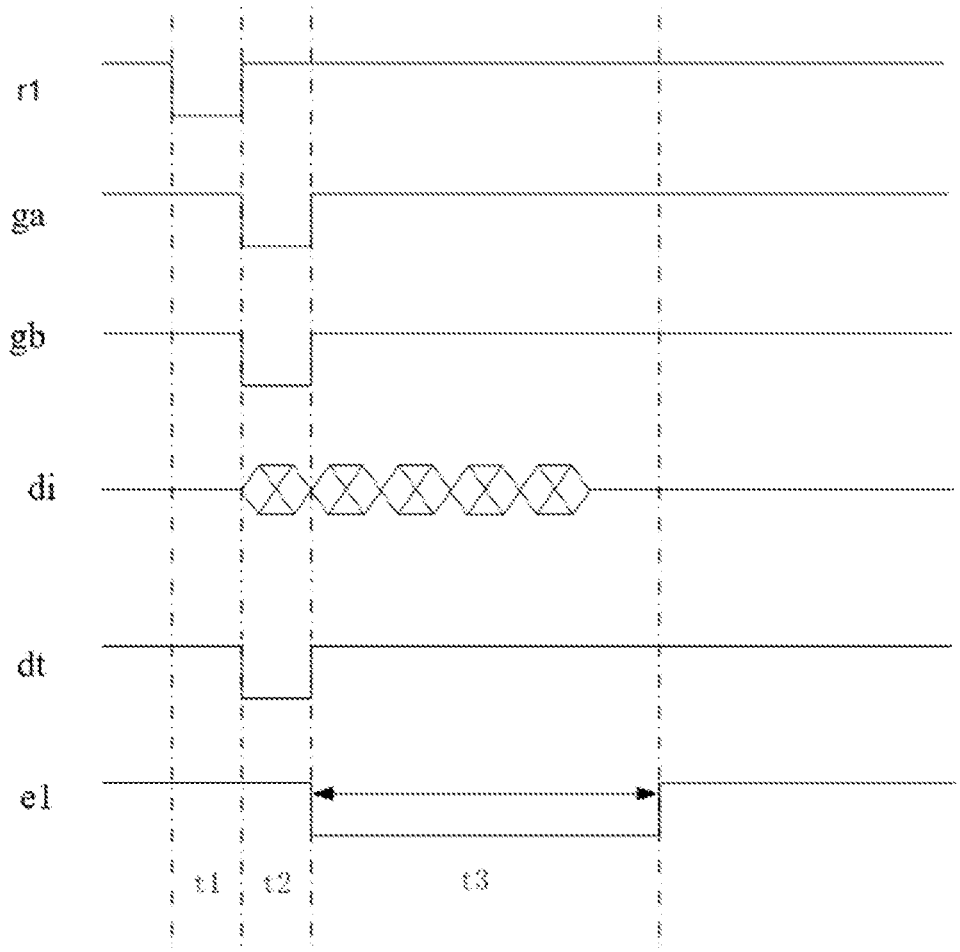
FIG. 4 is a sequence diagram of the pixel driving circuit in FIG. 3.

With reference to FIG. 4, it should be appreciated that, the first power source end VDD is configured to apply the first power source voltage Vdd to the driving module 11, and the first data end DT is configured to apply the first data voltage dt to the driving module 11. A light-emission control end E1 is configured to provide a light-emission control signal el.

It should further be appreciated that, the first grayscale range is different from the second grayscale range. The first grayscale range is a low grayscale range, and the second grayscale range is a high grayscale range. That is, a low grayscale display function is achieved when the light-emitting element emits light in accordance with the first driving current, and a high grayscale display function is achieved when the light-emitting element emits light in accordance with the second driving current.

As shown in FIG. 2, on the basis of the pixel driving circuit in FIG. 1, the pixel driving circuit further includes a first data write-in module 13 electrically coupled to a second data end DI, a first gate control end GA, the driving module 11 and the grayscale adjustment module 12, and configured to write a second data voltage di at the second data end DI into the driving module 11 and the grayscale adjustment module 12 under the control of a first gate control signal ga from the first gate control end GA.

During the operation of the pixel driving circuit in FIG. 2, at a data write-in stage, the first data write-in module 13 writes di into the driving module 11 and the grayscale adjustment module 12 under the control of the first gate control signal.

As shown in FIG. 2, on the basis of the pixel driving circuit in FIG. 1, the pixel driving circuit further includes a first light-emission control module 171 and a second light-emission control module 172. The driving module 11 is electrically coupled to the first power source end VDD through the first light-emission control module 171, and the grayscale adjustment module 12 is electrically coupled to the first power source end VDD through the first light-emission control module 171. The first light-emission control module 171 is electrically coupled to a light-emission control end E1, and configured to control the driving module 11 to be electrically coupled to the first power source end VDD and control the grayscale adjustment module 12 to be electrically coupled to the first power source end VDD under the control of a light-emission control signal el from the light-emission control end E1. The driving module 11 is electrically coupled to the light-emitting element L1 through the second light-emission control module 172, and the second light-emission control module 172 is electrically coupled to the light-emission control end E1, and configured to control the driving module 11 to be electrically coupled to the light-emitting element L1 under the control of the light-emission control signal el.

During the operation of the pixel driving circuit in FIG. 2, at a light-emission stage, the first light-emission control module 171 controls the driving module 11 to be electrically coupled to the first power source end VDD and controls the grayscale adjustment module 12 to be electrically coupled to the first power source end VDD under the control of the light-emission control signal el, and the second light-emission control module 172 controls the driving module 11 to be electrically coupled to the light-emitting element L1 under the control of the light-emission control signal el.

As shown in FIG. 2, on the basis of the pixel driving circuit in FIG. 1, the pixel driving circuit further includes a second data write-in module 18. The control end of the grayscale adjustment module 12 is electrically coupled to the first data end DT through the second data write-in module 18, and the second data write-in module 18 is further electrically coupled to a second gate control end GB, and configured to write the first data voltage dt into the control end of the grayscale adjustment module 12 under the control of a second gate control signal gb from the second gate control end GB.

During the operation of the pixel driving circuit in FIG. 2, at the data write-in stage, the second data write-in module 18 writes the first data voltage dt into the control end of the grayscale adjustment module 12 under the control of the second gate control signal gb.

As shown in FIG. 2, on the basis of the pixel driving circuit in FIG. 1, the pixel driving circuit further includes a compensation module 14 electrically coupled to the first gate control end GA, the gate voltage end Vg and the driving module 11, and configured to control the driving module 11 to be electrically coupled to the gate voltage end Vg under the control of the first gate control signal ga from the first gate control end GA.

During the operation of the pixel driving circuit in FIG. 2, at the data write-in stage, the compensation module 14 controls the driving module 11 to be electrically coupled to the gate voltage end Vg under the control of the first gate control signal ga, so as to compensate for a threshold voltage of a driving transistor in the driving module 11.

As shown in FIG. 2, on the basis of the pixel driving circuit in FIG. 1, the pixel driving circuit further includes a first energy storage module 151 and a second energy storage module 152. The first energy storage module 151 is electrically coupled to the gate voltage end Vg, and configured to store electric energy. The second energy storage module 152 is electrically coupled to the control end of the grayscale adjustment module 12, and configured to store electric energy. The first energy storage module 151 is further configured to maintain the potential at the gate voltage end Vg, and the second energy storage module 152 is further configured to maintain the potential at the control end of the grayscale adjustment module 12.

As shown in FIG. 2, on the basis of the pixel driving circuit in FIG. 1, the pixel driving circuit further includes a resetting module 16 electrically coupled to a resetting signal end F1, a resetting control end R1, the gate voltage end Vg and a first electrode of the light-emitting element L1, and configured to write a resetting signal from the resetting signal end F1 into the gate voltage end Vg and the first electrode of the light-emitting element L1 under control of a resetting control signal r1 from the resetting control end R1. A second electrode of the light-emitting element L1 is electrically coupled to a second power source end VSS.

During the operation of the pixel driving circuit in FIG. 2, at a resetting stage before the data write-in stage, the resetting module 16 writes the resetting signal into the gate voltage end Vg and the first electrode of the light-emitting element L1 under control of the resetting control signal r1, so as to enable the light-emitting element L1 not to emit light.

In a possible embodiment of the present disclosure, the grayscale adjustment module includes a first transistor, a first electrode of which is electrically coupled to the first power source end through the first light-emission control module, a second electrode of which is electrically coupled to the driving module, and a control electrode of which is electrically coupled to the first data end through the second data write-in module.

Figure 3:
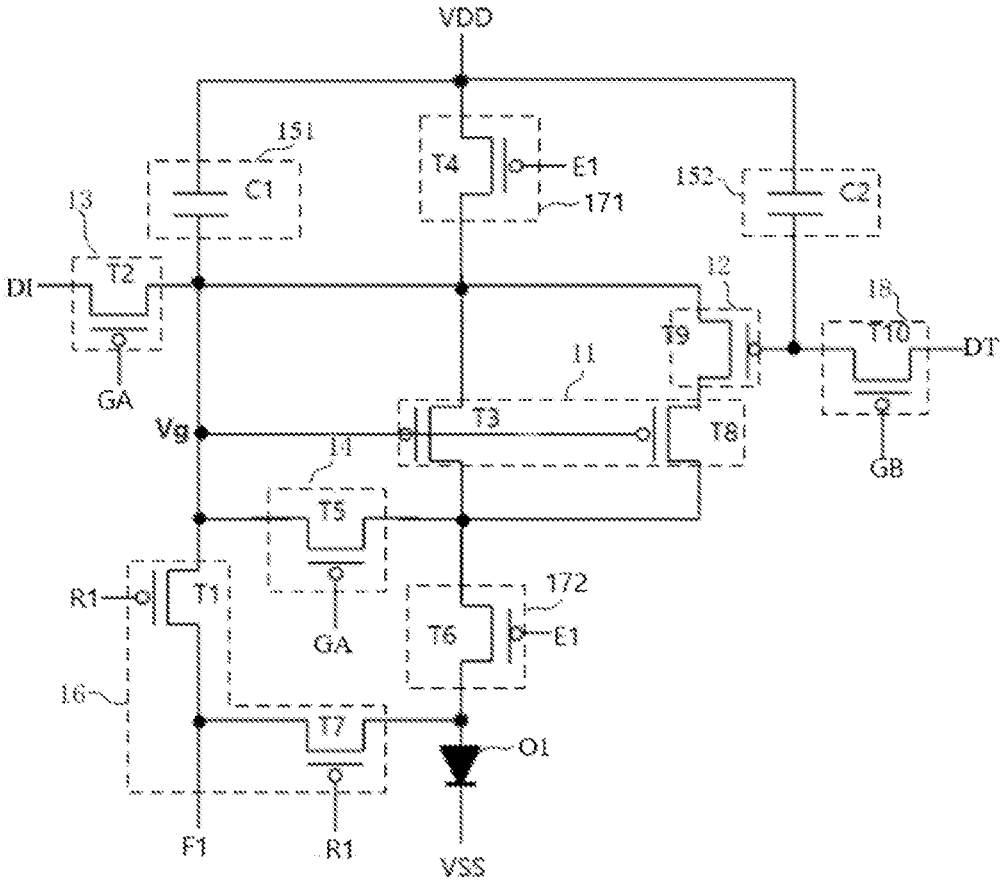
FIG. 3 is yet another schematic view showing the pixel driving circuit according to one embodiment of the present disclosure.

During the operation of the pixel driving circuit in FIG. 3, the light-emitting element is a light-emitting diode O1, which is, but not limited to, an OLED, a Micro-LED, a Mini-LED or a QLED.

As shown in FIG. 3, the grayscale adjustment module 12 includes a first transistor T9, a first electrode of which is electrically coupled to the first power source end VDD through the first light-emission control module 171, a second electrode of which is electrically coupled to the driving module 11, and a gate electrode of which is electrically coupled to the first data end D T through the second data write-in module 18.

In a possible embodiment of the present disclosure, the driving module includes a first driving transistor and a second driving transistor. A first electrode of the first driving transistor is electrically coupled to the first power source end through the first light-emission control module, a second electrode of the first driving transistor is electrically coupled to the light-emitting element through the second light-emission control module, a control electrode of the first driving transistor is electrically coupled to the gate voltage end, and the first driving transistor is configured to generate the first driving current. A first electrode of the second driving transistor is electrically coupled to the grayscale adjustment module, a second electrode of the second driving transistor is electrically coupled to the second electrode of the first driving transistor, a control electrode of the second driving transistor is electrically coupled to the gate voltage end, and the first driving transistor and the second driving transistor are configured to jointly generate the second driving current.

As shown in FIG. 3, the driving module 11 includes a first driving transistor T3 and a second driving transistor T8. A first electrode of the first driving transistor T3 is electrically coupled to the first power source end VDD through the first light-emission control module 171, the first electrode of the first driving transistor T3 is further electrically coupled to the second data end DI through the first data write-in module 13, a second electrode of the first driving transistor T3 is electrically coupled to an anode of light-emitting diode O1 through the second light-emission control module 172, and a gate electrode of the first driving transistor T3 is electrically coupled to the gate voltage end Vg. A first electrode of the second driving transistor T8 is electrically coupled to the second electrode of the first transistor T9, a second electrode of the second driving transistor T8 is electrically coupled to the second electrode of the first driving transistor T3, and a gate electrode of the second driving transistor T8 is electrically coupled to the gate voltage end Vg.

Each transistor in the embodiments of the present disclosure is a triode, a Thin Film Transistor (TFT), a Field Effect Transistor (FET), or any other element having a same characteristic. In order to differentiate two electrodes of the transistor, apart from a control electrode, from each other, one of the two electrodes us called as a first electrode, and the other may be called as a second electrode.

When the transistor is a triode, the control electrode is a base, the first electrode is a collector and the second electrode is an emitter, or the control electrode is a base, the first electrode is an emitter and the second electrode is a collector.

When the transistor is a TFT or FET, the control electrode is a gate electrode, the first electrode is a drain electrode and the second electrode is a source electrode, or the control electrode is a gate electrode, the first electrode is a source electrode and the second electrode is a drain electrode. The source electrode and the drain electrode of each of all or part of the transistors in the embodiments of the present disclosure are interchanged according to practical need.

In addition, the transistors include N-type transistors and P-type transistors according to the characteristics thereof. In FIG. 3, the description is given by taking each transistor being a P-type transistor as an example. That is, when a control electrode of the transistor receives a low-level signal, a first electrode of the transistor is electrically coupled to a second electrode of the transistor. Based on the description and teaching of the implementation of the P-type transistor in the embodiments of the present disclosure, a person skilled in the art may obtain the implementation of N-type transistors without any creative effort, which also falls within the scope of the present disclosure.

In at least one embodiment of the present disclosure, the first power source voltage is a high-level voltage, and the second power source voltage is a low-level voltage. The first data voltage dt and the second data voltage di are voltage signals, and dt is variable.

Further, a width-to-length ratio W/L of a channel of the first driving transistor T3 is smaller than a width-to-length ratio W/L of a channel of the second driving transistor T8. For example, the width-to-length ratio W/L of the channel of the first driving transistor T3 is less than 1, and specifically 0.5, 0.6, 0.7, 0.8, 0.9, etc. The width-to-length ratio W/L of the channel of the second driving transistor T8 is greater than 1, and specifically 1.2, 1.3, 1.5, 1.6, 1.7, 1.8, etc.

It should be appreciated that, the channel refers to a semiconductor layer between a source region and a drain region in the transistor. The width-to-length ratio W/L of the channel refers to a ratio of a width of the channel to a length of the channel in the transistor, which is an important parameter for the transistor. The greater the width-to-length ratio W/L of the channel, the greater the saturation current of the transistor, the better the performance and the smaller the subthreshold swing of the transistor. The smaller the width-to-length ratio W/L of the channel, and the higher the subthreshold swing of the transistor.

The subthreshold swing is a performance indicator measuring a conversion speed between an on-state and an off-state of the transistor, and it represents the amount of change in a gate voltage required when an amplitude of a source-drain current changes by one order of magnitude (for example, 10 times), also referred to as an S factor. The smaller the sub-threshold swing, the higher the turn-on/turn-off speed of the transistor, and the greater the driving current generated by the transistor in accordance with the potential at the gate electrode thereof. The larger the sub-threshold swing SS, the smaller the turn-on/turn-off speed of the transistor, and the smaller the driving current generated by the transistor in accordance with the potential at the gate electrode thereof. It should be appreciated that, the light-emitting element receives the first driving current generated by the first driving transistor to emit light, or receives the second driving current generated by the first driving transistor T3 and the second driving transistor T8 to emit light.

Hence, in the case that the light-emitting element has received the first driving current generated by the first driving transistor T3 to emit light, the first driving current I1 is calculated through the formula: $I_1=\frac{1}{2}\times K_1\times(V_{gs_T3}\ N_{th_T3})^2$, where $V_{gs_T3}$ is a gate-to-source voltage difference of the first driving transistor T3, $V_{th_T3}$ is a threshold voltage of the first driving transistor T3, $K_1=(W_1/L_1)\times C_1\times u_1$, $W_1/L_1$ is a width-to-length ratio of a channel of the first driving transistor T3, $C_1$ is an insulation layer capacitance of the channel of the first driving transistor T3, and $u_1$ is carrier mobility of the channel of the first driving transistor T3. The width-to-length ratio $W_1/L_1$ of the channel of the first driving transistor T3 is relatively small, and the subthreshold swing $SS_{T3}$ of T3 is relatively large, so an amplitude of the first driving current $I_1$ generated by the first driving transistor T3 under the control of the potential at the gate voltage end Vg is relatively small. As a result, it is able for the light-emitting element to achieve the low grayscale brightness values in accordance with the first driving current $I_1$.

In the case that the light-emitting element L1 has received the second driving current generated by the first driving transistor T3 and the second driving transistor T8 to emit light, the second driving current $I_2$ is calculated through the formula: $I_2=\frac{1}{2}\times K_2\times(V_{gs_T8}-V_{th_T8})2+\frac{1}{2}\times K_1\times(V_{gs_T3}-V_{th_T3})^2$, where $V_{gs_T3}$ is the gate-to-source voltage difference of the first driving transistor T3, $V_{th_T3}$ is the threshold voltage of the first driving transistor T3, $K_1=(W_1/L_1)\times C_1\times u_1$, $W_1/L_1$ is the width-to-length ratio of the channel of the first driving transistor T3, $C_1$ is the insulation layer capacitance of the channel of the first driving transistor T3, $u_1$ is the carrier mobility of the channel of the first driving transistor T3, $V_{gs_T8}$ is a gate-to-source voltage difference of the second driving transistor T8, $V_{th_T8}$ is a threshold voltage of the second driving transistor T8, $K_2=(W_2/L_2)\times C_2\times u_2$, $W_2/L_2$ is a width-to-length ratio of a channel of the second driving transistor T8, $C_2$ is an insulation layer capacitance of the channel of the second driving transistor T8, and $u_2$ is carrier mobility of the channel of the second driving transistor T8. The width-to-length ratio $W_2/L_2$ of the channel of the second driving transistor T8 is larger, and the sub-threshold swing $SS_{T8}$ of T8 is smaller, so an amplitude of the second driving current $I_2$ generated by the first driving transistor T3 and the second driving transistor T8 is larger than the amplitude of the first driving current $I_1$. As a result, it is able for the light-emitting element to achieve the high grayscale brightness values in accordance with the second driving current $I_2$. In a word, it is able for the light-emitting element L1 to achieve both the low grayscale brightness values and the high grayscale brightness values.

In a possible embodiment of the present disclosure, as shown in FIG. 3, the first data write-in module 13 includes a data write-in transistor T2, a first electrode of which is electrically coupled to the second data end DI, and a gate electrode of which is connected to the first gate electrode GA, and a second end of which is electrically coupled to the driving module 11 and the grayscale adjustment module 12. When the data write-in transistor T2 is turned on under the control of the first gate control signal ga from the first gate control end GA, it transmits the second data voltage di from the second data end DI to the driving module 11 and the grayscale adjustment module 12.

In at least one embodiment of the present disclosure, as shown in FIG. 3, the grayscale adjustment module 12 includes the first transistor T9 configured to control the first electrode of T3 to be electrically coupled to or electrically disconnected from the first electrode of T8 under the control of a potential at a control end thereof.

In a possible embodiment of the present disclosure, as shown in FIG. 3, the compensation module 14 includes a compensation transistor T5, a first electrode of which is electrically coupled to the second electrode of the first driving transistor T3 and the second electrode of the second driving transistor T8, a second electrode of which is electrically coupled to the gate voltage end Vg, and a gate electrode of which is electrically coupled to the first gate control end GA. The compensation transistor T5 is configured to control the gate voltage end Vg to be electrically coupled to the second electrode of T3, and control the gate voltage end Vg to be electrically coupled to the second electrode of T8 under the control of the first gate control signal from the first gate control end GA.

In a possible embodiment of the present disclosure, as shown in FIG. 3, the first energy storage module 151 includes a first storage capacitor C1, and the second energy storage module 152 includes a second storage capacitor C2. A first electrode plate of the first storage capacitor C1 is electrically coupled to the gate voltage end Vg, and a second electrode plate of the first storage capacitor C1 is electrically coupled to the first power source end VDD. A first electrode plate of the second storage capacitor C2 is electrically coupled to the control end of the grayscale adjustment module 12, and a second electrode plate of the second storage capacitor C2 is electrically coupled to the first power source end VDD. The first storage capacitor C1 is configured to store electric energy and maintain the potential at the gate voltage end Vg, and the second storage capacitor C2 is configured to store electric energy and maintain the potential at the control end of the grayscale adjustment module 12.

In at least one embodiment of the present disclosure, as shown in FIG. 2, the pixel driving circuit 10 further includes the resetting module 16 configured to write a resetting signal from the resetting signal end R1 into the gate voltage end Vg and the first electrode of the light-emitting element L1 under control of a resetting control signal r1 from the resetting control end R1, so as to reset the potential at the gate voltage end Vg and the potential at the first electrode of the light-emitting element L1.

It should be appreciated that, the resetting signal end F1 is configured to apply the resetting signal Vi which is a low-level signal. The resetting control end R1 is configured to apply the resetting control signal r1 to the resetting module 16, and the resetting control signal r1 is switched between a high voltage and a low voltage.

In a possible embodiment of the present disclosure, as shown in FIG. 3, the resetting module 16 includes a first resetting transistor T1 and a second resetting transistor T7. A first electrode of the first resetting transistor T1 is electrically coupled to the resetting signal end F1, a second electrode of the first resetting transistor T1 is electrically coupled to the gate voltage end Vg, and a gate electrode of the first resetting transistor T1 is electrically coupled to the resetting control end R1. A first electrode of the second resetting transistor T7 is electrically coupled to the resetting signal end F1, a second electrode of the second resetting transistor T7 is electrically coupled to the anode of the light-emitting diode O1, and a gate electrode of the second resetting transistor T7 is electrically coupled to the resetting control end R1.

During the operation of the pixel driving circuit in FIG. 3, at the resetting stage before the data write-in stage, T1 and T7 are turned on, so as to write Vi into Vg and the anode of O1, thereby to enable T3 to be turned on at the beginning of the data write-in stage and control O1 not to emit light.

In addition, during the high-grayscale display, at the data write-in stage, the gate electrode of T9 receives a low-voltage signal, and T9 is turned on. Thus, at the beginning of the data write-in stage, it is able for T8 to be turned on. During the low-grayscale display, at the data write-in stage, T9 receives a high voltage signal, and T9 is turned off.

As shown in FIG. 3, the first light-emission control module 171 includes a first light-emission control transistor T4, and the second light-emission control module 172 includes a second light-emission control transistor T6. A first electrode of the first light-emission control transistor T4 is electrically coupled to the first voltage end VDD, a second electrode of the first light-emission control transistor T4 is electrically coupled to the first electrode of T3 and the first electrode of T9, and a gate electrode of the first light-emission control transistor T4 is electrically coupled to the light-emission control end E1. A first electrode of the second light-emission control transistor T6 is electrically coupled to the second electrode of T3 and the second electrode of T8, a second electrode of the second light-emission control transistor T6 is electrically coupled to the anode of the light-emitting diode O1, and a gate electrode of the second light-emission control transistor T6 is electrically coupled to the light-emission control end E1.

It should be appreciated that, the light-emission control end E1 is configured to apply the light-emission control signal el to the first light-emission control transistor T4 and the second light-emission control transistor T6. The light-emission control signal el is a voltage signal, and it is switched between a high voltage and a low voltage.

In at least one embodiment of the present disclosure, the pixel driving circuit 10 further includes a second data write-in module 18 configured to write the first data voltage dt into the control end of the grayscale adjustment module 12 under the control of a second gate control signal gb from the second gate control end GB.

It should be appreciated that, the second gate control end GB is configured to apply the second gate control signal gb to the second data write-in module 18, and the second gate control signal gb is switched between a high voltage and a low voltage.

In at least one embodiment of the present disclosure, the gate electrode of T9 is, but not limited to, the control end of the grayscale adjustment module 12.

As shown in FIG. 3, the second data write-in module 18 includes a second transistor T10, a first electrode of which is electrically coupled to the first data end DT, a gate electrode of which is electrically coupled to the second gate control end GB, and a second electrode of which is electrically coupled to the gate electrode of T9. In the case that the second gate control signal gb from the second gate control end GB is a low level, the second transistor T10 is turned on, so as to write the first data voltage dt from the first data end DT into the gate electrode of T9.

As shown in FIG. 4, during the high-grayscale display of the pixel driving circuit in FIG. 3, a display period includes a resetting stage t1, a data write-in stage t2 and a light-emission stage t3 arranged one after another.

At the resetting stage t1, the resetting control signal r1 is a low level, the first gate control signal ga, the second gate control signal gb, the second data voltage di and the light-emission control signal el are each a high level, the first resetting transistor T1 and the second resetting transistor T7 are turned on, and the first resetting transistor T1 writes the resetting signal Vi into the gate voltage end Vg, so as to reset the gate electrode of the first driving transistor T3 and the gate electrode of the second driving transistor T8. Thus, at the beginning of the data write-in stage t2, it is able to turn on the first driving transistor T3 and the second driving transistor T8. C1 maintains the potential at Vg, C2 maintains the potential at the gate electrode of T9, and the second resetting transistor T7 writes the resetting signal Vi to the anode of the light-emitting diode O1, so as to enable O1 not to emit light.

At the data write-in stage t2, the first gate control signal ga, the second gate control signal gb and the first data voltage dt are each a low level, and the resetting control signal r1 and the light-emission control signal el are each a high level. T4, T6, T1 and T7 are all turned off, the data write-in transistor T2, the second transistor T10 and the compensation transistor T5 are turned on, the second transistor T10 transmits the first data voltage dt to the gate electrode of the first transistor T9 and the second storage capacitor C2, the first transistor T9 is turned on, and the data write-in transistor T2 writes the second data voltage di into the gate voltage end Vg.

When the data write-in stage t2 starts, T3 and T8 are turned on, and C1 is charged through the second data voltage di to increase the potential at the gate electrode of T3 and the potential at the gate electrode of T8 until both T3 and T8 are turned off. At this time, the potential at the gate voltage end Vg is compensated to a larger one of $(di+V_{th_T3})$ and $(di+V_{th_T8})$. $V_{th_T3}$ is the threshold voltage of T3, and $V_{th_T8}$ is the threshold voltage of T8.

At the light-emission stage t3, the light-emission control signal el is a low level, and the first gate control signal ga, the second gate control signal gb and the first data voltage dt are each a high level. The first driving transistor T3 and the second driving transistor T8 are turned on, the first light-emission control transistor T4 and the second light-emission control transistor T6 are turned on, T10 is turned off, and the first transistor T9 is electrically disconnected from the first data end DT. The second storage capacitor C2 maintains the potential at the gate electrode of the first transistor T9 as a low level, the first transistor T9 is turned on, and the first driving transistor T3 and the second driving transistor T8 are connected in parallel to jointly generate the second driving current $I_2$. The second driving current $I_2$ drives the light-emitting diode O1 to emit light, and it is able for the light-emitting diode O1 to achieve the high grayscale brightness values.

Figure 5:
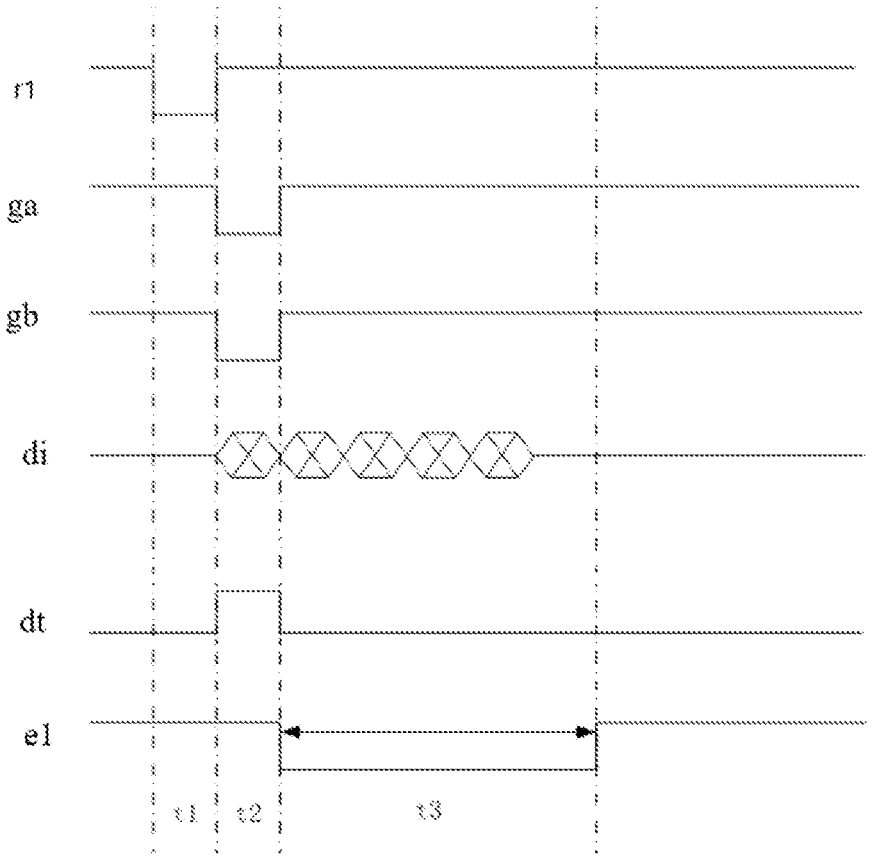
FIG. 5 is another sequence diagram of the pixel driving circuit in FIG. 3.

As shown in FIG. 5, during the low-grayscale display of the pixel driving circuit in FIG. 3, a display period includes a resetting stage t1, a data write-in stage t2 and a light-emission stage t3 arranged one after another.

At the resetting stage t1, the resetting control signal r1 is a low level, the first gate control signal ga, the second gate control signal gb, the second data voltage di and the light-emission control signal el are each a high level, the first resetting transistor T1 and the second resetting transistor T7 are turned on, and the first resetting transistor T1 writes the resetting signal Vi into the gate voltage end Vg, so as to reset the gate electrode of the first driving transistor T3. Thus, at the beginning of the data write-in stage t2, it is able to turn on the first driving transistor T3. C1 maintains the potential at Vg, C2 maintains the potential at the gate electrode of T9, and the second resetting transistor T7 writes the resetting signal Vi to the anode of the light-emitting diode O1, so as to enable O1 not to emit light.

At the data write-in stage t2, the first gate control signal ga, the second gate control signal gb are each a low level, and the resetting control signal r1 and the first data voltage dt are each a high level. The data write-in transistor T2, the second transistor T10 and the compensation transistor T5 are turned on, the second transistor T10 transmits the first data voltage dt to the gate electrode of the first transistor T9, the first transistor T9 is turned off, and the data write-in transistor T2 writes the second data voltage di into the gate voltage end Vg.

When the data write-in stage t2 starts, T3 is turned on, C1 is charged through di to increase the potential at the gate electrode of T3 until the potential at the gate voltage end Vg is compensated to $(di+V_{th_T3})$, and then T3 is turned off.

At the light-emission stage t3, the light-emission control signal el and the first data voltage dt are each a low level, and the first gate control signal ga, the second gate control signal gb and the resetting control signal r1 are each a high level. The first driving transistor T3 and the second driving transistor T8 are turned on, and the first light-emission control transistor T4 and the second light-emission control transistor T6 are turned on. The second storage capacitor C2 maintains the potential at the gate electrode of the first transistor T9 as a high level, the first transistor T9 is turned off, and the first driving transistor T3 generates the first driving current $I_1$. The first driving current $I_1$ drives the light-emitting diode O1 to emit light, and it is able for the light-emitting diode O1 to achieve the low grayscale brightness values.

The present disclosure further provides in some embodiments a driving control method for the above-mentioned pixel driving circuit. A display period includes a data write-in stage and a light-emission stage. The method includes: S12 of, at the data write-in stage, applying a first data voltage at the first data end to the control end of the grayscale adjustment module, and applying a second data voltage to the gate voltage end; and S14 of, at the light-emission stage, generating, by the grayscale adjustment module, an adjustment signal under the control of the control end thereof, and generating, by the driving module, a second driving current corresponding to a second grayscale range under the control of a first power source voltage at the first power source end, a potential at the gate voltage end and the adjustment signal from the grayscale adjustment module.

The present disclosure further provides in some embodiments a driving control method for the above-mentioned pixel driving circuit. A display period includes a data write-in stage and a light-emission stage. The method includes: S16 of, at the data write-in stage, applying a second data voltage to the gate voltage end; and S18 of, at the light-emission stage, generating, by the driving module, a first driving current corresponding to a first grayscale range under the control of the first power source voltage at the first power source end and the potential at the gate voltage end.

Figure 6:
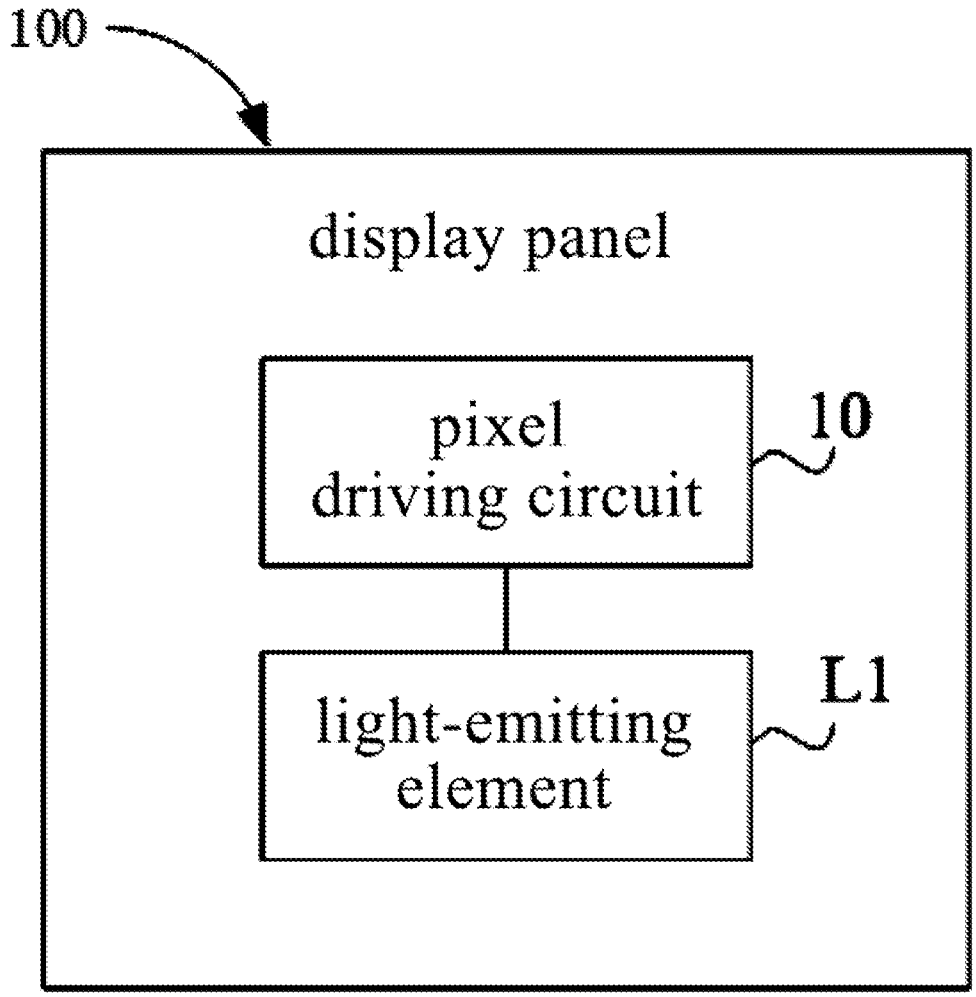
FIG. 6 is a schematic view showing a display panel according to one embodiment of the present disclosure.

Referring to FIG. 6, the present disclosure further provides in some embodiments a display panel 100 including the light-emitting element L1 and the above-mentioned pixel driving circuit 10. The pixel driving circuit 10 is configured to drive the light-emitting element L1 to emit light.

In at least one embodiment of the present disclosure, the display panel 100 includes a plurality of pixels arranged in an array form and shift registers coupled to each other in a cascaded manner, each row of pixels corresponds to a shift register, and each pixel includes one pixel driving circuit 10 and one light-emitting element L1 electrically coupled to the pixel driving circuit 10. The shift register in a current row is configured to apply a first gate control signal, a second gate control signal, a light-emission control signal and a time control signal to the pixel driving circuit 10 in the current row, and the shift register in a previous row is configured apply a resetting control signal to the pixel driving circuit 10 in the current row.

The display panel 100 further includes a plurality of first data lines and a plurality of second data lines, the pixel driving circuits 10 of pixels in a same column are electrically coupled to a same first data line, and/or, the pixel driving circuits 10 of the pixels in the same column are electrically coupled to a same second data line. The pixel driving circuits 10 of the pixels in the same column are electrically coupled to a same gate control signal line, a same light-emission control signal line and a same time control signal line. The first power source ends VDD of all pixels are electrically coupled to each other or receive a same signal. The resetting signal ends F1 of all pixels are coupled to each other or receive a same signal. The second power source ends VSS of all pixels are electrically coupled to each other or receive a same signal.

Such phrases as "one embodiment", "embodiments", "examples" and "for example" intend to indicate that the features, structures or materials are contained in at least one embodiment or example of the present disclosure, rather than referring to an identical embodiment or example. In addition, the features, structures or materials may be combined in any embodiment or embodiments in an appropriate manner.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel driving circuit for driving a light-emitting element, comprising a driving module and a grayscale adjustment module, wherein the driving module is coupled to a gate voltage end, a first power source end, the light-emitting element and the grayscale adjustment module, and configured to generate a first driving current corresponding to a first grayscale range under the control of a potential at the gate voltage end and a first power source voltage at the first power source end, and transmit the first driving current to the light-emitting element; and the grayscale adjustment module is further coupled to the first power source end, a control end of the grayscale adjustment module is coupled to a first data end, and the grayscale adjustment module is configured to adjust the driving module under the control of the first power source voltage and a first data voltage at the first data end, so that the driving module generates a second driving current corresponding to a second grayscale range under the control of the potential at the gate voltage end and the first power source voltage, and transmits the second driving current to the light-emitting element;

wherein the pixel driving circuit further comprises a first data write-in module electrically coupled to a second data end, a first gate control end, the driving module and the grayscale adjustment module, and configured to write a second data voltage at the second data end into the driving module and the grayscale adjustment module under the control of a first gate control signal from the first gate control end.

2. The pixel driving circuit according to claim 1, further comprising a first light-emission control module and a second light-emission control module, wherein the driving module is electrically coupled to the first power source end through the first light-emission control module, and the grayscale adjustment module is electrically coupled to the first power source end through the first light-emission control module;

the first light-emission control module is electrically coupled to a light-emission control end, and configured to control the driving module to be electrically coupled to the first power source end and control the grayscale adjustment module to be electrically coupled to the first power source end under the control of a light-emission control signal from the light-emission control end; and the driving module is electrically coupled to the light-emitting element through the second light-emission control module, the second light-emission control module is electrically coupled to the light-emission control end, and configured to control the driving module to be electrically coupled to the light-emitting element under the control of the light-emission control signal.

3. The pixel driving circuit according to claim 2, further comprising a second data write-in module, wherein the control end of the grayscale adjustment module is electrically coupled to the first data end through the second data write-in module, the second data write-in module is further electrically coupled to a second gate control end, and configured to write the first data voltage into the control end of the grayscale adjustment module under the control of a second gate control signal from the second gate control end.

4. The pixel driving circuit according to claim 3, wherein the grayscale adjustment module comprises a first transistor, a first electrode of which is electrically coupled to the first power source end through the first light-emission control module, a second electrode of which is electrically coupled to the driving module, and a control electrode of which is electrically coupled to the first data end through the second data write-in module.

5. The pixel driving circuit according to claim 3, wherein the second data write-in module comprises a second transistor, a first electrode of which is electrically coupled to the first data end, a control electrode of which is electrically coupled to the second gate control end, and a second electrode of which is electrically coupled to the control end of the grayscale adjustment module.

6. The pixel driving circuit according to claim 2, wherein the first light-emission control module comprises a first light-emission control transistor, and the second light-emission control module comprises a second light-emission control transistor;

a control electrode of the first light-emission control transistor is electrically coupled to the light-emission control end, a first electrode of the first light-emission control transistor is electrically coupled to the first voltage end, and a second electrode of the first light-emission control transistor is electrically coupled to the driving module and the grayscale adjustment module; and a control electrode of the second light-emission control transistor is electrically coupled to the light-emission control end, a first electrode of the second light-emission control transistor is electrically coupled to the driving module, and a second electrode of the second light-emission control transistor is electrically coupled to the light-emitting element.

7. The pixel driving circuit according to claim 2, wherein the driving module comprises a first driving transistor and a second driving transistor;

a first electrode of the first driving transistor is electrically coupled to the first power source end through the first light-emission control module, a second electrode of the first driving transistor is electrically coupled to the light-emitting element through the second light-emission control module, a control electrode of the first driving transistor is electrically coupled to the gate voltage end, and the first driving transistor is configured to generate the first driving current; and a first electrode of the second driving transistor is electrically coupled to the grayscale adjustment module, a second electrode of the second driving transistor is electrically coupled to the second electrode of the first driving transistor, a control electrode of the second driving transistor is electrically coupled to the gate voltage end, and the first driving transistor and the second driving transistor are configured to jointly generate the second driving current.

8. The pixel driving circuit according to claim 7, wherein a width-to-length ratio of a channel of the first driving transistor is smaller than a width-to-length ratio of a channel of the second driving transistor.

9. The pixel driving circuit according to claim 7, further comprising a compensation module electrically coupled to a first gate control end, the gate voltage end, the second electrode of the first driving transistor and the second electrode of the second driving transistor, and configured to control the second electrode of the first driving transistor to be electrically coupled to the gate voltage end and control the second electrode of the second driving transistor to be electrically coupled to the gate voltage end under the control of a first gate control signal from the first gate control end.

10. The pixel driving circuit according to claim 9, wherein the compensation module comprises a compensation transistor, a first electrode of which is electrically coupled to the second electrode of the first driving transistor and the second electrode of the second driving transistor, a second electrode of which is electrically coupled to the gate voltage end, and a control electrode of which is electrically coupled to the first gate control end.

11. The pixel driving circuit according to claim 1, wherein the first data write-in module comprises a data write-in transistor, a first electrode of which is electrically coupled to the second data end, and a control electrode of which is connected to the first gate electrode, and a second end of which is electrically coupled to the driving module and the grayscale adjustment module.

12. The pixel driving circuit according to claim 1, further comprising a first energy storage module and a second energy storage module, wherein the first energy storage module is electrically coupled to the gate voltage end, and configured to store electric energy and maintain the potential at the gate voltage end; and the second energy storage module is electrically coupled to the control end of the grayscale adjustment module, and configured to store electric energy and maintain the potential at the control end of the grayscale adjustment module.

13. The pixel driving circuit according to claim 12, wherein the first energy storage module comprises a first storage capacitor, and the second energy storage module comprises a second storage capacitor;

a first electrode plate of the first storage capacitor is electrically coupled to the gate voltage end, and a second electrode plate of the first storage capacitor is electrically coupled to the first power source end; and a first electrode plate of the second storage capacitor is electrically coupled to the control end of the grayscale adjustment module, and a second electrode plate of the second storage capacitor is electrically coupled to the first power source end.

14. The pixel driving circuit according to claim 1, further comprising a resetting module electrically coupled to a resetting signal end, a resetting control end, the gate voltage end and a first electrode of the light-emitting element, and configured to write a resetting signal from the resetting signal end into the gate voltage end and the first electrode of the light-emitting element under control of a resetting control signal from the resetting control end, wherein a second electrode of the light-emitting element is electrically coupled to a second power source end.

15. The pixel driving circuit according to claim 14, wherein the resetting module comprises a first resetting transistor and a second resetting transistor;

a first electrode of the first resetting transistor is electrically coupled to the resetting signal end, a second electrode of the first resetting transistor is electrically coupled to the gate voltage end, and a control electrode of the first resetting transistor is electrically coupled to the resetting control end; and a first electrode of the second resetting transistor is electrically coupled to the resetting signal end, a second electrode of the second resetting transistor is electrically coupled to the first electrode of the light-emitting element, and a control electrode of the second resetting transistor is electrically coupled to the resetting control end.

16. A driving control method for the pixel driving circuit according to claim 1, a display period comprising a data write-in stage and a light-emission stage, and the method comprising:

at the data write-in stage, applying a first data voltage at the first data end to the control end of the grayscale adjustment module, and applying a second data voltage to the gate voltage end; and at the light-emission stage, generating, by the grayscale adjustment module, an adjustment signal under the control of a potential at the control end of the grayscale adjustment module, and generating, by the driving module, a second driving current under the control of a first power source voltage at the first power source end, a potential at the gate voltage end and the adjustment signal from the grayscale adjustment module;

or the method comprising:

at the data write-in stage, applying a second data voltage to the gate voltage end; and at the light-emission stage, generating, by the driving module, a first driving current under the control of the first power source voltage at the first power source end and the potential at the gate voltage end.

17. A display panel, comprising the light-emitting element and the pixel driving circuit according to claim 1, wherein the pixel driving circuit is configured to drive the light-emitting element to emit light.

18. The display panel according to claim 17, wherein the pixel driving circuit further comprises a first light-emission control module and a second light-emission control module;

the driving module is electrically coupled to the first power source end through the first light-emission control module, and the grayscale adjustment module is electrically coupled to the first power source end through the first light-emission control module;

the first light-emission control module is electrically coupled to a light-emission control end, and configured to control the driving module to be electrically coupled to the first power source end and control the grayscale adjustment module to be electrically coupled to the first power source end under the control of a light-emission control signal from the light-emission control end; and the driving module is electrically coupled to the light-emitting element through the second light-emission control module, the second light-emission control module is electrically coupled to the light-emission control end, and configured to control the driving module to be electrically coupled to the light-emitting element under the control of the light-emission control signal.

19. The display panel according to claim 18, wherein the pixel driving circuit further comprises a second data write-in module, the control end of the grayscale adjustment module is electrically coupled to the first data end through the second data write-in module, the second data write-in module is further electrically coupled to a second gate control end, and configured to write the first data voltage into the control end of the grayscale adjustment module under the control of a second gate control signal from the second gate control end.

* * * * *